United States Patent [19]

Nomura

[11] Patent Number: 4,862,504

[45] Date of Patent: Aug. 29, 1989

[54] SPEECH SYNTHESIS SYSTEM OF RULE-SYNTHESIS TYPE

[75] Inventor: Norimasa Nomura, Yokohama, Japan

[73] Assignee: Kabushiki Kaisha Toshiba, Kawasaki, Japan

[21] Appl. No.: 167

[22] Filed: Jan. 2, 1987

[30] Foreign Application Priority Data

Jan. 9, 1986 [JP] Japan ..... 61-2481

[51] Int. Cl.[4] ..... G10L 5/02

[52] U.S. Cl. ..... 381/51

[58] Field of Search ..... 381/51-53; 364/513.5

[56] References Cited

U.S. PATENT DOCUMENTS 4,689,817 8/1987 Kroon ..... 381/52

FOREIGN PATENT DOCUMENTS 0058130 8/1982 European Pat. Off. .

0107945 11/1980 United Kingdom .

OTHER PUBLICATIONS

Cepstral Synthesis of Japanese From CV Syllable Parameters, Satoshi Imai and Yoshiharu Abe, Tokyo Institute of Technology, 4/1980, IEEE, Chapter 1559, pp. 557-560.

*Primary Examiner*—Vit W. Miska

*Attorney, Agent, or Firm*—Oblon, Fisher, Spivak, McClelland & Maier

[57] ABSTRACT

In order to generate a series of speech parameters from a series of phonemic symbols extracted from a series of input characters, parameters for given syllables or phonemes are read from corresponding parameter files according to the types of immediately preceding vowels or consonants of the given syllables or phonemes in the series of phonemic symbols. The syllable or phoneme parameters ar combined to produce a series of speech parameters.

5 Claims, 4 Drawing Sheets

SPEECH SYNTHESIS SYSTEM OF RULE-SYNTHESIS TYPE

BACKGROUND OF THE INVENTION

The present invention relates to a rule-synthesis type, speech synthesis system for effectively synthesizing fluent speech outputs.

Speech synthesis is an important means for man-machine interface. Various types of conventional speech synthesis systems are known. A rule-synthesis type, speech synthesis system is known for its ability of synthesizing and outputting a large number of various words and phrases.

A conventional speech synthesis system of this type analyzes any series of input characters to obtain both phonemic and rhythmic information thereof, and generates a synthesized speech on the basis of predetermined rules.

The prior applications concerning synthesis-by-rule speech synthesis and assigned to the assignee of the present invention are U.S. patent application Ser. No. 541,027 filed on Oct. 12, 1983, and U.S. patent application Ser. No. 646,096 filed on Aug. 31, 1984.

However, rule-synthesis type speech is not fluent at transition portions between speech segments such as syllables and phonemes and is difficult for man to understand.

SUMMARY OF THE INVENTION

It is an object of the present invention to provide a rule-synthesis type, speech synthesis system for producing fluent and clear synthesized speech.

When a series of speech parameters are derived from a series of phonemic symbols obtained by analyzing a series of input characters used in, for example, Japanese language, the parameters representing features of syllables are obtained according to the environments where syllables or speech segments, as units of speech synthesis, are present, that is, according to the type of immediately preceding vowel of a syllable of interest as a speech segment. The parameters are combined to obtain a series of speech parameters, thereby synthesizing speech by rule.

Parameters for syllables are predetermined according to the types of immediately preceding vowels of syllables of interest. When a syllable parameter for any syllable in the series of phonemic symbols is to be obtained, one of the syllable parameters is selected according to the vowel immediately preceding the syllable.

According to the present invention, since a series of speech parameters corresponding to a string of speech segments (e.g., syllables) are generated, fluency of the speech synthesized by rule can be improved. The understandability of the synthesized speech is not degraded, and thus the above-mentioned fluency can be guaranteed. It is relatively easy to synthesize high-quality speech by rule, thus providing many advantages in practical applications.

DETAILED DESCRIPTION OF THE PREFERRED EMBODIMENTS

Figure 1:
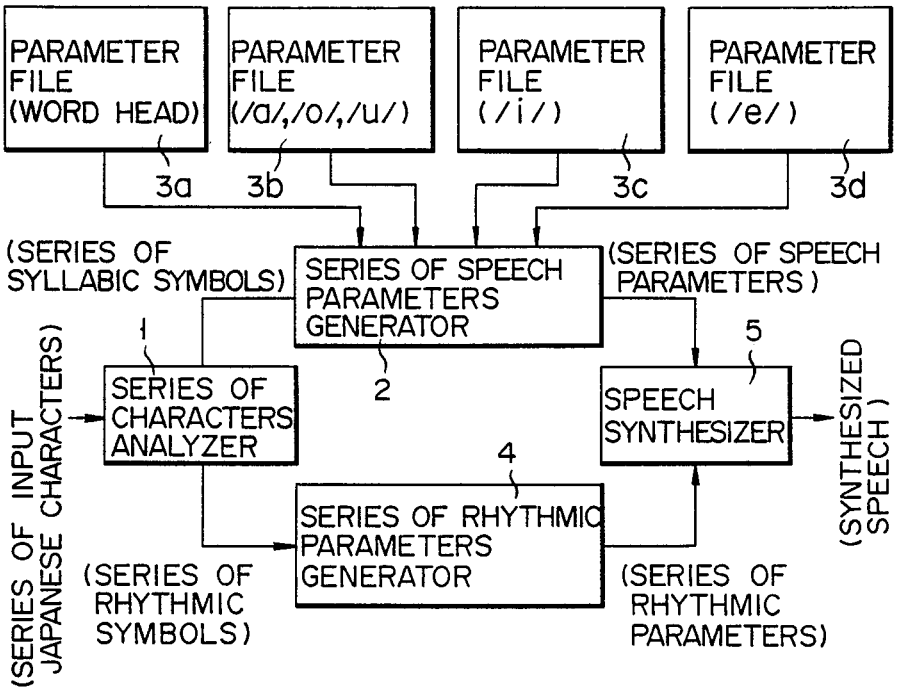
FIG. 1 is a block diagram of a rule-synthesis type speech synthesis system according to an embodiment of the present invention.

An embodiment of the present invention will be described in detail with reference to the accompanying drawings. Referring to FIG. 1, data representing a series of input Japanese characters [ 適格 Kanji] is sent from a computer (not shown) or a character key input device (not shown) to analyzer 1 for analyzing a series of characters. Such data represents characters constituting a word [tekikaku]. Analyzer 1 analyzes the input data and generates a series of syllabic symbols [te·ki·ka·ku] and a series of rhythmic symbols such as pitches, accents and intonations according to the series of input characters. Analyzer 1 can be constituted by a known analyzer disclosed in, e.g., "Acoustic, Speech and Signal Processing", at Proc. IEEE, Intern. Confr., PP 557–560, 1980, and a detailed description thereof will be omitted. Data representing the series of syllabic symbols and rhythmic symbols are supplied to generator 2 for generating a series of speech parameters and generator 4 for generating the series of rhythmic parameters, respectively.

Generator 2 for generating the series of speech parameters accesses parameters files 3*a*, 3*b*, 3*c*, and 3*d* for the speech segments (syllable, in this case) in the series of syllabic symbols to obtain speech segment parameters. The speech segment parameters are combined by generator 2 to produce a series of speech parameters representing tracheal characteristics of speech. This combination is achieved by linear interpolation (to be described later) in this embodiment. Syllables are used as speech segments in this embodiment. Syllables are sequentially detected by generator 2 according to the series of syllabic symbols sent from analyzer 1. parameter files 3*a* to 3*d* are accessed for each detected syllable to obtain the corresponding syllable parameter.

Generator 4 for generating the series of rhythmic parameters generates a series of rhythmic parameters such as accent according to the input series of phonemic symbols. The series of rhythmic parameters from generator 4 and the series of speech parameters from generator 2 are supplied to speech synthesizer 5. Synthesizer 5 generates synthesized speech corresponding to the series of input characters.

Assume that the speech segment as the unit of speech synthesis is defined as syllable CV as a combination of consonant C and vowel V.

Figure 2:
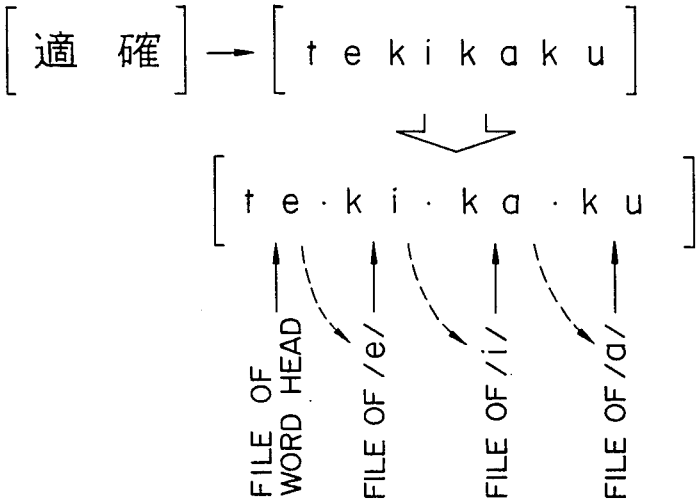
FIG. 2 is a chart for explaining the relationship between a series of phonemic symbols and syllables.

In this embodiment, a kanji word " 適格 " is supplied as data representing a series of input characters to analyzer 1 and a series of phonemic symbols of this word is given as [tekikaku], as shown in FIG. 2, wherein /t/ and /k/ are phonemic symbols of consonants and /e/, /i/, /a/, and /u/ are phonemic symbols of vowels. The series of phonemic symbols is divided into four syllables [te·ki·ka·ku], as shown in FIG. 2. Respective syllable parameters are obtained in consideration of their immediately preceding vowels. In this embodiment, word head file 3*a*, file 3*b* for vowels /a/, /o/, and /u/, file 3*c* for vowel /i/, and file 3*d* for vowel /e/ are prepared beforehand according to the types of immediately preceding vowels.

It is possible to prepare separate parameter files for five vowels /a/, /e/, /i/, /o/, and /u/. However, independent parameter files for only vowels /i/ and /e/ produced by expanding lips in the lateral direction are prepared in this embodiment. Common file 3*b* is prepared for vowels /a/, /o/, and /u/, thereby reducing the number of files.

Word head parameter file 3*a* is prepared such that natural speech generated in units of syllables is analyzed, and the analysis results are converted into parameters.

Parameter file 3*c* for immediately preceding vowel i/ is prepared in the following manner. Two consecutive syllables having vowel /i/ in the first syllable in natural speech are analyzed, and only the parameter of the second syllable is extracted. For example, a natural speech having two syllables [i·ke]is spoken, and the analysis result of second syllable /ke/ is extracted and converted into a parameter of which data is stored in file 3*c* prepared for immediately preceding vowel /i/.

A syllable parameter for immediately preceding vowel /e/ is prepared in the same manner as described above and stored in file 3*d*.

Syllable parameters for vowels /a/, /o/, and /u/ positioned immediately before the corresponding syllables are prepared as follows. Two consecutive syllables having vowel /a/ in the first syllable are analyzed to extract only the second syllable, and the corresponding parameter is prepared in the same manner as described above. In this case, operations for vowels /o/ and /u/ can be omitted. If the same operations as in vowel /a/ are performed for vowel /o/, operations for vowels /a/ and /u/ can be omitted in this case as a matter of fact.

Figure 3:
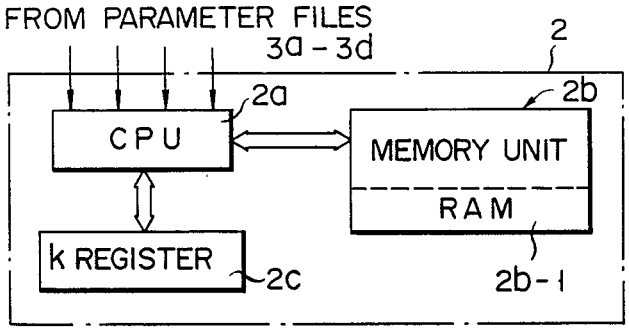
FIG. 3 is a block diagram of a generator for generating a series of speech parameters in the system of FIG. 1.

The operation of generator 2 for generating the series of speech parameters for the series of phonemic symbols [te·ki·ka·ku](FIG. 2) will be described with reference to FIGS. 3 and 4.

Generator 2 for generating the series of speech parameters comprises CPU 2*a*, memory unit 2*b* such as a program memory and a working memory, and k register 2*c*. CPU 2*a* receives syllables constituting a series of phonemic symbols and determines whether input syllable data represents the beginning of a word. If syllable data represents the second or subsequent syllable, CPU 2*a* also determines the type of immediately preceding vowel. On the basis of the determination results, CPU 2*a* selects the parameter file for obtaining the corresponding syllable parameter. Syllable parameters are read out from the parameter files selected in units of syllables. In this embodiment, the syllable parameters are sequentially connected by linear interpolation, thereby generating a series of speech parameters.

Figure 4:
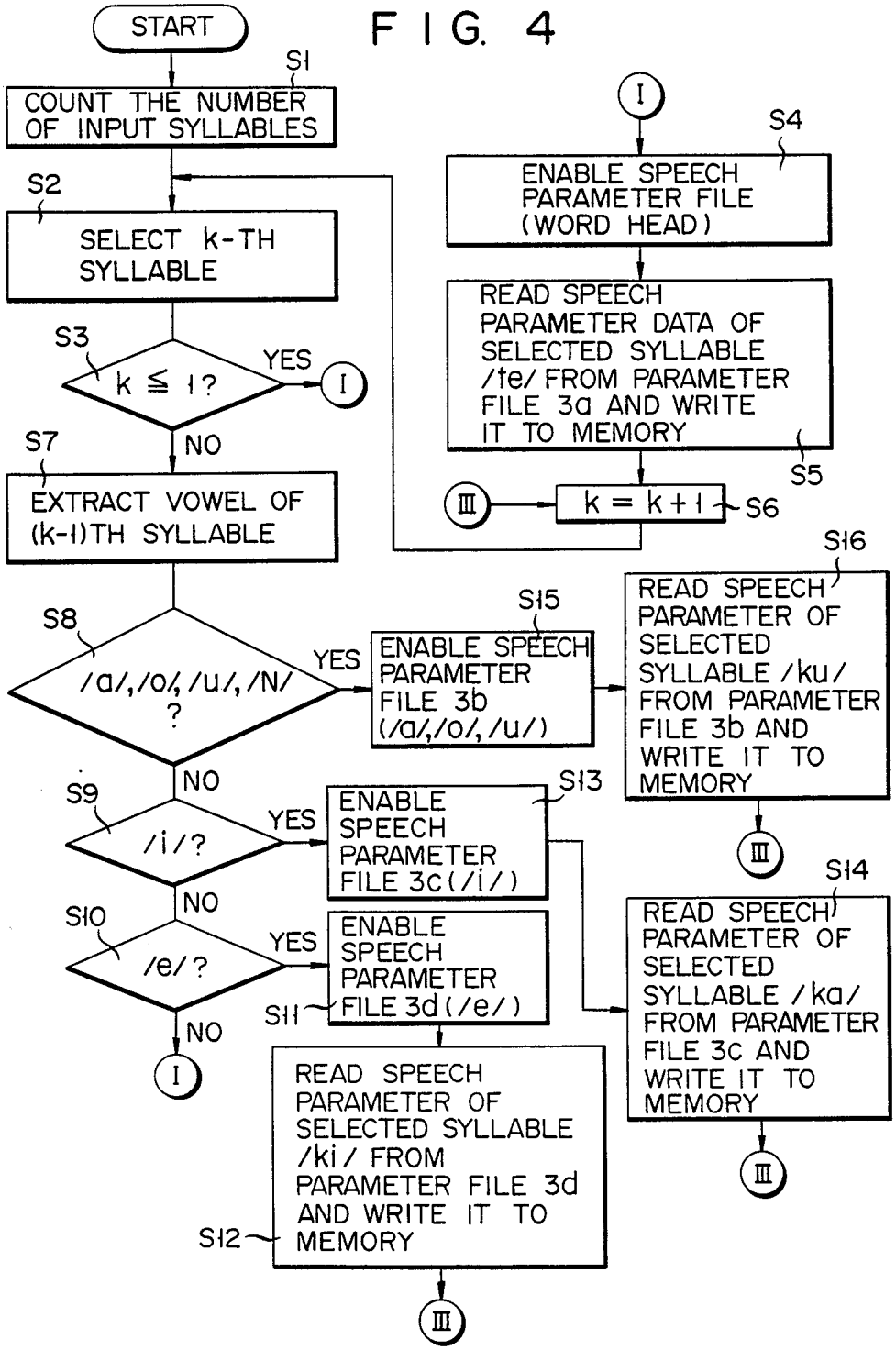
FIG. 4 is a flow chart for explaining the operation of the system in FIGS. 1 to 3.

When the series of phonemic symbols [te·ki·ka·ku] is input to generator 2 for generating the series of speech parameters, the number N of input syllables is counted in step S1 in FIG. 4, and the series of phonemic symbols input therein is stored in memory unit 2*b*. Thereafter, the flow advances to step S2. The kth (k=1, 2, . . . N) syllable data from the first syllable data is read out from memory unit 2*b*. In this embodiment, the number N of input syllables is 4, and "1" is set in k register 2*c*.

The flow advances to step S3, and CPU 2*a* determines whether the input syllable is the first syllable (i.e., $k \leqq 1$?). Since head syllable /te/ data is input and the content of k register 2*c* is "1", step S3 is determined to be YES and the flow advances to step S4. CPU 2*a* determines according to the content of register 2*c* in step S4 that the input syllable is the word head syllable (k=1). CPU 2*a* enables word head parameter file 3*a*.

Figure 5:
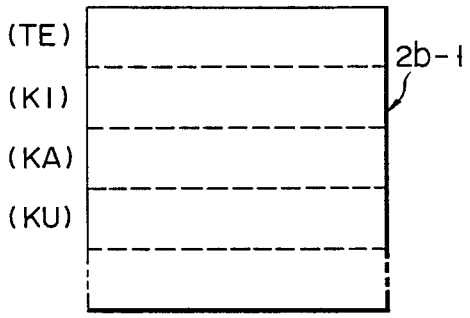
FIG. 5 is a memory map showing the area allocation in a memory unit in FIG. 3.

In step S5, a speech parameter representing syllable /te/ is extracted from file 3*a* and stored in RAM 2*b*−1 in memory unit 2*b*. A state wherein parameter data of syllable /te/ is stored in RAM 2*b*−1 in memory unit 2*b* is shown in FIG. 5. In step S6, the content of register 2*c* is incremented by one and thus updated to k=2.

The flow returns from step S6 to step S2, and the next syllable data /ki/ is read out from memory unit 2*b*. Since the content of k register 2*c* is updated to 2, step S3 for checking whether the syllable of interest is word head is determined to be NO, and the flow advances to step S7. The immediately preceding vowel is vowel /e/ in the first syllable /te/ since the syllable of interest is the (k−1)th syllable, i.e., 2−1=1. Therefore, vowel /e/ is extracted as the one of interest.

The extracted vowel /e/ is checked for correspondence with one of vowels /a/, /o/, /u/, and /N/ in step S8. Step S8 is determined to be NO, and the flow advances to step S9. CPU 2*a* checks in step S9 whether the extracted vowel is /i/. Step S9 is determined to be NO, and the flow advances to step S10. CPU 2*a* determines in step S10 whether the extracted vowel is /e/. In this case, step S10 is determined to be YES, and the flow advances to step S11.

In step S11, speech parameter file 3*d* for immediately preceding vowel /e/ is enabled. In step S12, a speech parameter representing syllable /ki/ is extracted from the speech parameters for immediately preceding vowel /e/. Parameter data of syllable /ki/ is stored next to /te/ in RAM 2*b*−1, as shown in FIG. 5. When storage operation is completed, the flow advances to step S6. In step S6, register 3*c* is incremented by one L and thus updated to k=3. The operation routine then returns to step S2, and the third syllable /ka/ is read out.

The flow advances to step S7 through step S3, and the immediately preceding vowel, i.e., vowel /i/ of second syllable /ki/ is extracted as the object of interest. The routine advances to step S9 through step S8. Step 9 is determined to be YES, and the flow then advances to step S13. Speech parameter file 3*c* for immediately preceding vowel /i/ is enabled in step S13.

The flow advances to step S14, and speech parameter data representing syllable /ka/ in the case of immediately preceding vowel /i/ is read out from file 3*c*. As shown in FIG. 5, the extracted data is stored in the third memory area in RAM 2*b*−*1*.

In step S6, the content of register 3*c* is incremented by one and thus updated to k=4. The flow returns to step S2 again, and the fourth syllable /ku/ is read out, and corresponding immediately preceding vowel /a/ is detected in step S7. Step S8 is determined to be YES. In this case, the flow advances to step S15, and speech parameter file 3*b* for immediately preceding vowel /a/ is enabled. The speech parameter representing syllable /ku/ for immediately preceding vowel /a/ is extracted in step S16 and is stored in the fourth memory area of RAM 2*b*−1.

The flow again returns to step S6, and k=5 is set in k register 3*c*. The flow returns to step S2 again. A total number of syllables included in the series of input phonemic symbols is 4. The fifth syllable is not present in the memory unit 2*b*, and speech parameter extraction is interrupted.

Figure 6:
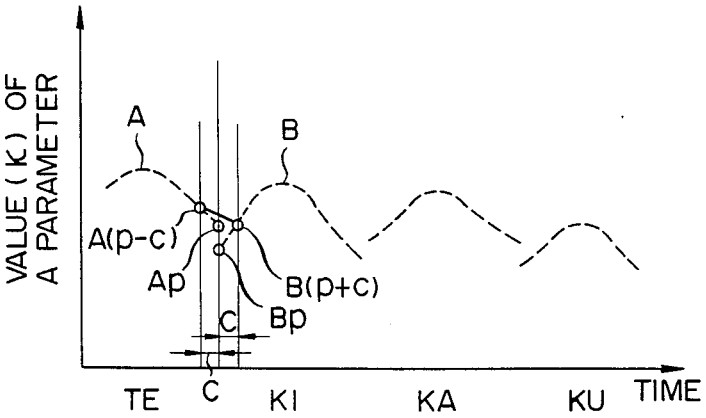
FIG. 6 is a graph for explaining interpolation at the time of generation of a series of speech parameters.

Level distribution of speech parameter data of four syllables [te·ki·ka·ku] stored in RAM 2*b*-1 is plotted along the time basis, as shown in FIG. 6. As is apparent from FIG. 6, no large differences between the transition portions between the adjacent parameter values of syllables are present, and smooth intersyllabic transitions can be achieved. In order to obtain smoother transitions, linear interpolation is used in this embodiment. Assume that spectral curves of parameters of syllables /te/ and /ki/ are represented as plots A and B, and that a step is present between terminal end Ap of plot A and start end Bp of plot B. In order to perform linear interpolation, CPU 2*a* reads out data of point A(p−c) from RAM 2*b*−1. Point A(p−c) is lagged by predetermined period C from terminal end Ap of plot A of syllable /te/. CPU 2*a* also reads out data of point B(p+c) from RAM 2*b*−1. Point B(p+c) is advanced by predetermined period C from start point BP of plot B of syllable /ki/. Data representing line AB connecting points A(p−c) and B(p+c) is stored, and interpolation is thus performed.

Syllable parameters selectively extracted from parameter files 3*a* to 3*d* are sequentially interpolated to supply a series of speech parameters for the series of phonemic symbols [te·ki·ka·ku] to speech synthesizer 5.

Figure 7:
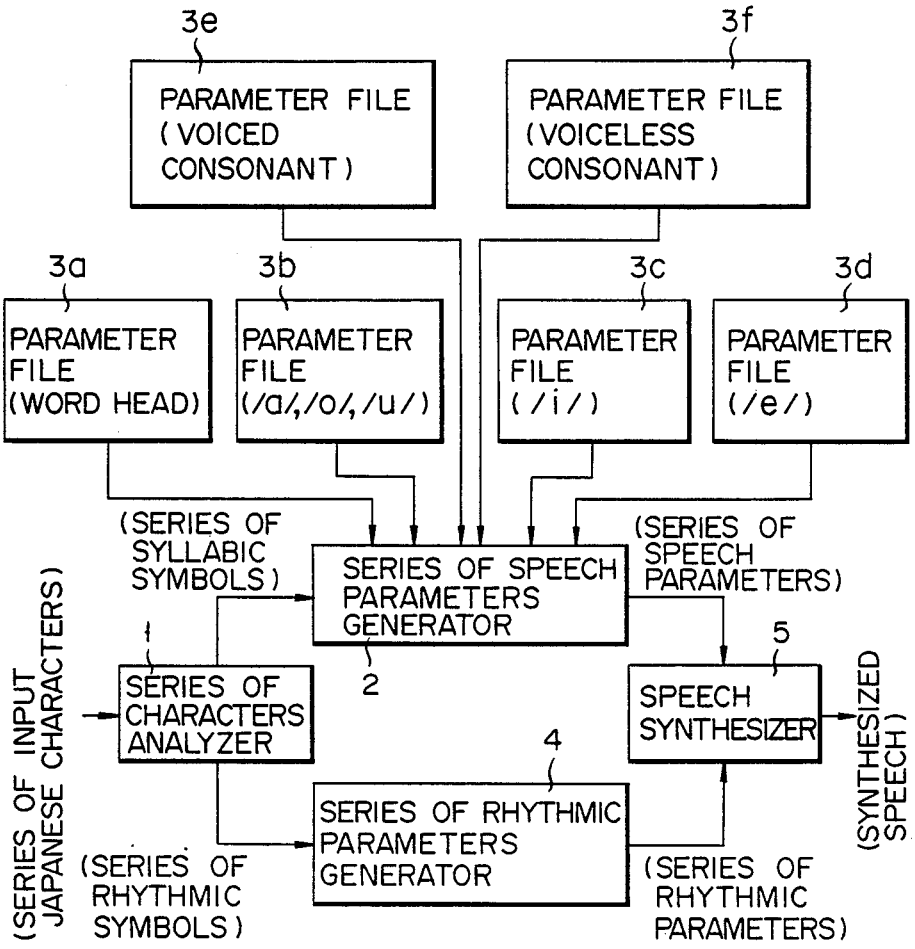
FIG. 7 is a block diagram of a rule-synthesis type speech synthesis system according to another embodiment of the present invention.

In the above embodiment, the speech segment is a syllable. However, the speech segment may be a phoneme. For example, in order to output synthesized speech corresponding to a series of input characters of an English word [school], speech parameter files are required for respective phonemes /s/, /k/, /u:/, and /1/ for phonemic notation [skû:1]. Since the parameter files for vowels are already prepared in the above embodiment, at least two additional speech parameter files for consonants are required. More specifically, one speech parameter file for consonants is the one required in the case wherein the immediately preceding consonant is a voiced consonant, and the other speech parameter file for consonants is the one required in the case wherein the immediately preceding consonant is a voiceless consonant. These two parameter files are added to the arrangement in FIG. 1. The resultant arrangement is shown in FIG. 7. The same reference numerals as in FIG. 1 denote the same parts in FIG. 7, and a detailed description thereof will be omitted.

Referring to FIG. 7, in addition to word head parameter file 3*a* and vowel parameter files 3*b* to 3*d*, voiced consonant parameter file 3*e* and voiceless consonant parameter file 3*f* are arranged.

For example, if a series of input characters is [school], a series of phonemic symbols output from character analyzer 1 is given as [s·k·u:·1]. This series of phonemic symbols is supplied to generator 2 for generating a series of speech parameters. A speech parameter of word head phoneme /s/ is obtained first. When a speech parameter of the second phoneme /k/ is obtained, the corresponding speech parameter is derived in consideration of immediately preceding phoneme /s/. Since immediately preceding phoneme /s/ is a voiceless phoneme, file 3*f* is selected, and a speech parameter of phoneme /k/ having immediately preceding phoneme /s/ is read out from file 3*f*. In the same manner as described above, speech parameters are sequentially derived for the phonemes constituting [school]in consideration of immediately preceding phonemes. The resultant speech parameters are linearly interpolated and combined, and are supplied as a series of speech parameters to speech synthesizer 5.

In each embodiment described above, generator 4 for generating a series of rhythmic symbols and speech synthesizer 5 may comprise known devices used in normal synthesis by rule. For example, the devices disclosed in "Acoustic, Speech and Signal Processing", at Proc. IEEE, Intern. Confr., PP557-560, 1980 can be used, and a detailed description thereof will be omitted.

According to the present invention, the speech parameters derived for the speech segments such as syllables and phonemes are determined in consideration of influences of changes in immediately preceding speech segments. The speech synthesized by rule is natural and fluent. In addition, understandability as the advantage of synthesis by rule is not lost. As a result, the resultant speech has high understandability level and can be readily understood with a clear and a fluent flow of speech.

Parameter files are prepared for speech segments and selectively used. Therefore, a series of speech parameters can be easily generated and many advantages are obtained in practical applications.

What is claimed is:

1. A speech synthesis system comprising:

a character analyzing means for analyzing a series of input characters to generate a series of syllabic symbols and a series of rhythmic symbols according to the series of input characters;

a plurality of parameter file means for storing speech parameters determined by taking into consideration an influence of immediately preceding vowels of the syllabic symbols;

a speech parameter generating means for generating a series of speech parameters by combining speech parameters obtained from said parameter file means in accordance with a determined vowel immediately preceding a syllabic symbol of said series of syllabic symbols;

rhythmic parameter generating means for generating a series of rhythmic parameters according to the series of rhythmic symbols supplied from said character analyzing means; and a speech synthesizing means for synthesizing said series of speech parameters and said series of rhythmic parameters.

2. A speech synthesis system according to claim 1, wherein said speech parameter generating means further comprises means for determining immediately preceding vowels and consonants of respective syllabic symbol and accessing said parameter file means according to the types of the determined vowels and consonants.

3. A system according to claim 1, further including means for linearly interpolating connecting portions of the speech parameters sequentially derived from said parameter files in correspondence with the series of input characters.

4. A system according to claim 1, wherein said plurality of parameter files include a first file commonly arranged for vowels /a/,/o., and /u/. a second file arranged for vowel /i., a third file arranged for vowel /e/. and a fourth file for a word head.

5. A system according to claim 4, further including a fifth file arranged for a voiced consonant and a sixth file arranged for a voiceless consonant.

* * * * *